US009974999B2

(12) United States Patent
Land

(10) Patent No.: US 9,974,999 B2
(45) Date of Patent: May 22, 2018

(54) MACHINE OR APPARATUS FOR PERFORMING EXERCISES

(71) Applicant: Steve Land, Wamego, KS (US)

(72) Inventor: Steve Land, Wamego, KS (US)

( * ) Notice: Subject to any disclaimer, the term of this patent is extended or adjusted under 35 U.S.C. 154(b) by 0 days. days.

(21) Appl. No.: 15/184,639

(22) Filed: Jun. 16, 2016

(65) Prior Publication Data

US 2016/0296794 A1 Oct. 13, 2016

Related U.S. Application Data

(60) Provisional application No. 62/295,903, filed on Feb. 16, 2016.

(51) Int. Cl.

| | |
|---|---|
| ***A61H 1/02*** | (2006.01) |
| ***A63B 21/00*** | (2006.01) |
| ***A63B 23/00*** | (2006.01) |
| ***A63B 23/035*** | (2006.01) |
| ***A63B 23/04*** | (2006.01) |

(52) U.S. Cl.

CPC .. *A63B 23/03508* (2013.01); *A63B 21/00047* (2013.01); *A63B 23/04* (2013.01); *A61H 1/0237* (2013.01); *A61H 1/0266* (2013.01); *A61H 2001/0248* (2013.01); *A61H 2201/0161* (2013.01); *A61H 2201/0192* (2013.01); *A61H 2201/1261* (2013.01); *A61H 2201/164* (2013.01); *A61H 2201/1633* (2013.01); *A61H 2201/1635* (2013.01); *A63B 2023/006* (2013.01)

(58) Field of Classification Search

CPC .... A61H 1/005; A61H 1/0237–1/0259; A61H 2001/0203; A61H 2001/0248; A63B 21/4029–21/4031; A63B 21/4049; A63B 23/0482–23/0488; A63B 2210/00; A63B 2210/50–2210/58

See application file for complete search history.

(56) References Cited

U.S. PATENT DOCUMENTS 5,569,132 A * 10/1996 Wu ..... A63B 21/068 482/72
2012/0065037 A1* 3/2012 Chen ..... A63B 21/00181 482/140
2013/0337984 A1* 12/2013 Lung ..... A63B 21/0421 482/140
2017/0036052 A1* 2/2017 Wang ..... A63B 21/023

* cited by examiner

*Primary Examiner* — Loan H Thanh
*Assistant Examiner* — Jennifer M Deichl
(74) *Attorney, Agent, or Firm* — Fitch Even Tabin & Flannery, LLP

(57) ABSTRACT

Embodiments of the inventive subject matter include an apparatus for performing stretching exercises. In some embodiments, the apparatus comprises a base, a seat, and an upright member. Additionally, in some embodiments, the seat is connected to the base and can rotate with respect to the base. In some embodiments, the upright member is connected to the base and includes a leg bar assembly.

18 Claims, 8 Drawing Sheets

MACHINE OR APPARATUS FOR PERFORMING EXERCISES

RELATED APPLICATIONS

This application claims the priority benefit of U.S. Provisional Application Ser. No. 62/295,903 filed on Feb. 16, 2016.

FIELD OF THE INVENTION

This invention relates generally to apparatuses for exercising and, more particularly, to apparatuses for stretching.

BACKGROUND OF THE INVENTION

A significant portion of the population will experience back pain in their lifetime. Because the back comprises a complex system of bones, nerves, muscles, etc., back pain can have many different causes. In many cases, back pain results from a direct injury to the back (e.g., a fall) or is related to a sedentary lifestyle (e.g., not getting enough exercise, staying seated for long periods of time, etc.). One frequent treatment of back pain involves stretching the muscles of the lower back and legs. In many instances back pain can be treated, and in some cases prevented, with regular exercise and stretching. While machines designed for aerobic and strengthening exercise are quite common (e.g., treadmills and weight benches), relatively few exercise machines exist that are designed to aid in proper stretching and stretching techniques.

In addition to the issues related to back pain, there is a large push within our society to improve flexibility and prevent many of the aches and pains associated with aging by maintaining an improved flexibility level. There are very few machines available that focus on proper stretching and stretching techniques for the general populous, and even fewer that allow aging individuals to stretch safely and correctly while still addressing multiple muscle groups within one machine.

BRIEF DESCRIPTION OF THE DRAWINGS

Embodiments of the inventive subject matter are illustrated in the figures of the accompanying drawings in which.

DETAILED DESCRIPTION

Introduction

Figure 1:
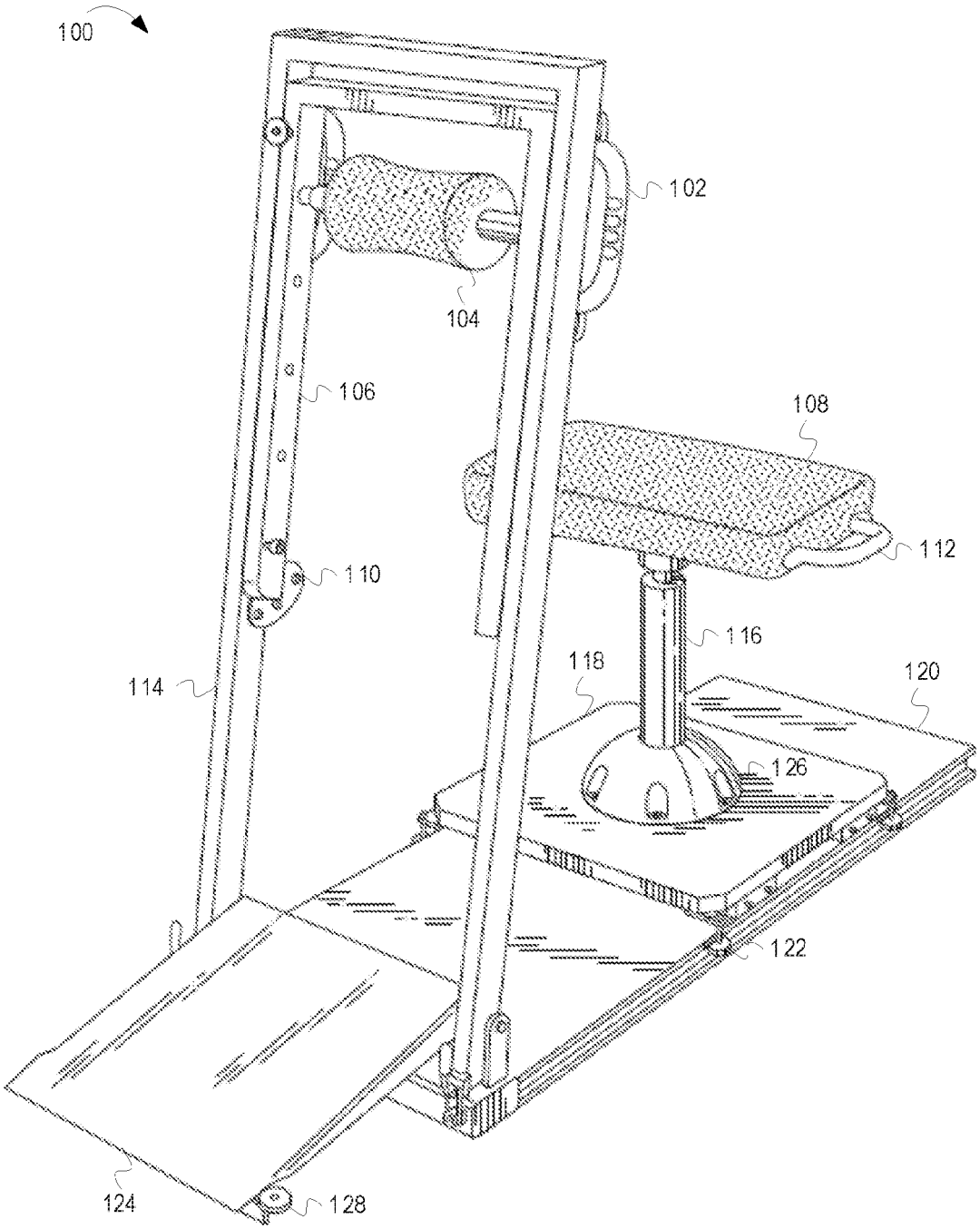
FIG. 1 is a perspective view of an example machine 100 that can aid in proper stretching techniques, according to some embodiments of the inventive subject matter.
Figure 2:
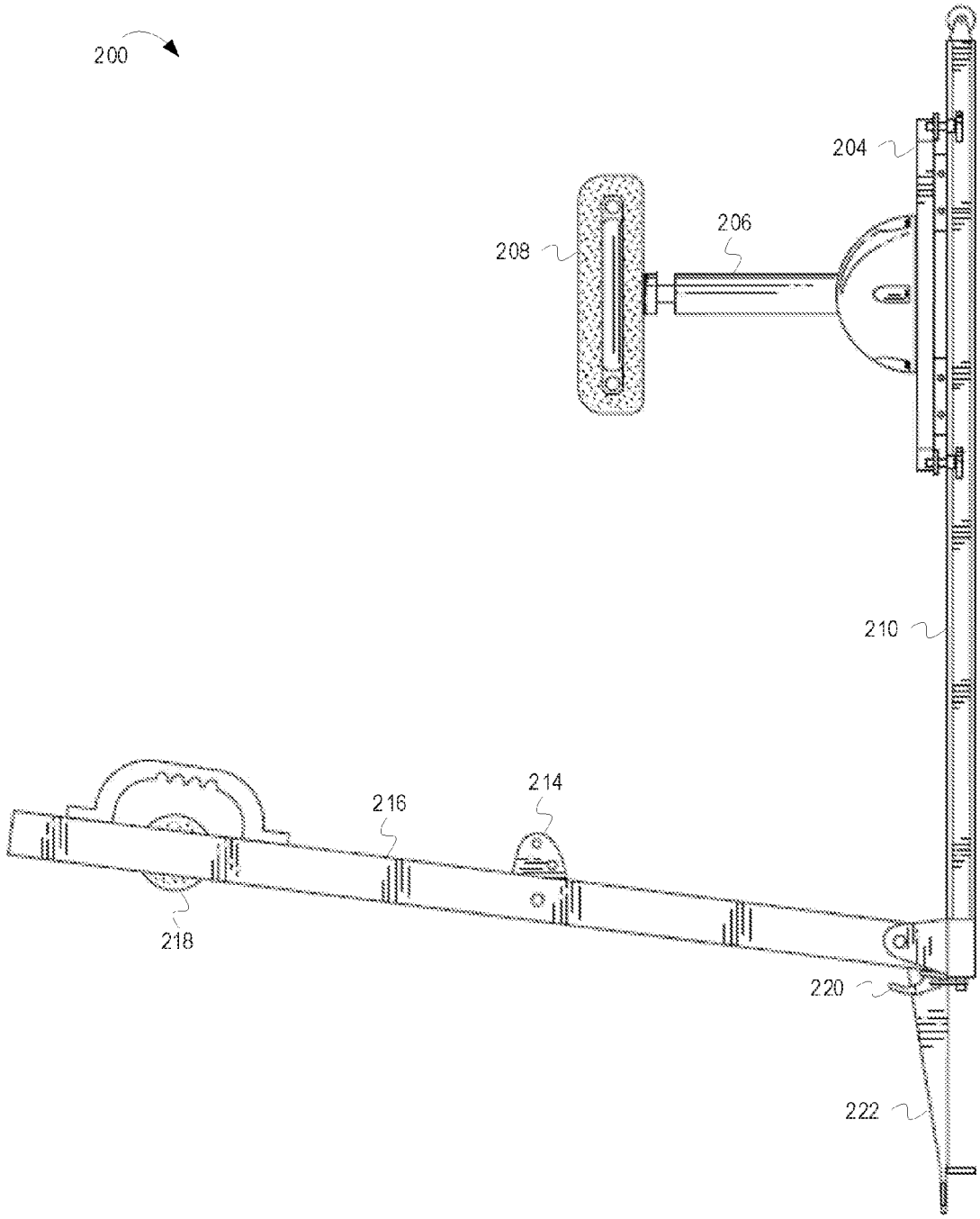
FIG. 2 is a side view of an example machine 200 that can aid in proper stretching techniques, according to some embodiments of the inventive subject matter.

As previously discussed, relatively few exercise machines focus on proper stretching and stretching techniques. Even fewer machines exist that allow a person to perform stretching exercises that allow for a variety of stretches while maintaining a person's safety and ease of transfer during use. Embodiments of the inventive subject matter include a machine or apparatus designed to aid in proper stretching and stretching techniques that allow a person's body to remain in, or remain close to, a natural position during the stretching exercises. For example, the machine or apparatus can be designed to allow a person to perform one or more stretching exercises using the machine. FIGS. 1 and 2 depict one example embodiment of such a machine.

FIG. 1 is a perspective view of an example machine 100 that can aid in proper stretching techniques, according to some embodiments of the inventive subject matter. The machine 100 includes a base 120. An upright portion 114, ramp 124, and seat base 118 are connected to the base 120. Alternatively, the ramp 124 can be connected to the upright member 114. A seat 108 is attached to the seat base 118 via a seat post 116 and seat assembly 126. Additionally, in some embodiments (as depicted in FIG. 1) the machine 100 can include handles such as upright bar handles 102 and seat handles 112. The handles can help a person balance while using the machine 100 and/or instruct the person as to proper form. For example the handles can include markings and the person can be instructed as to proper form based on the markings. The machine could also include a back support attached to seat 108 (not depicted) to help the person maintain a neutral lumbar spine.

Figure 4A:
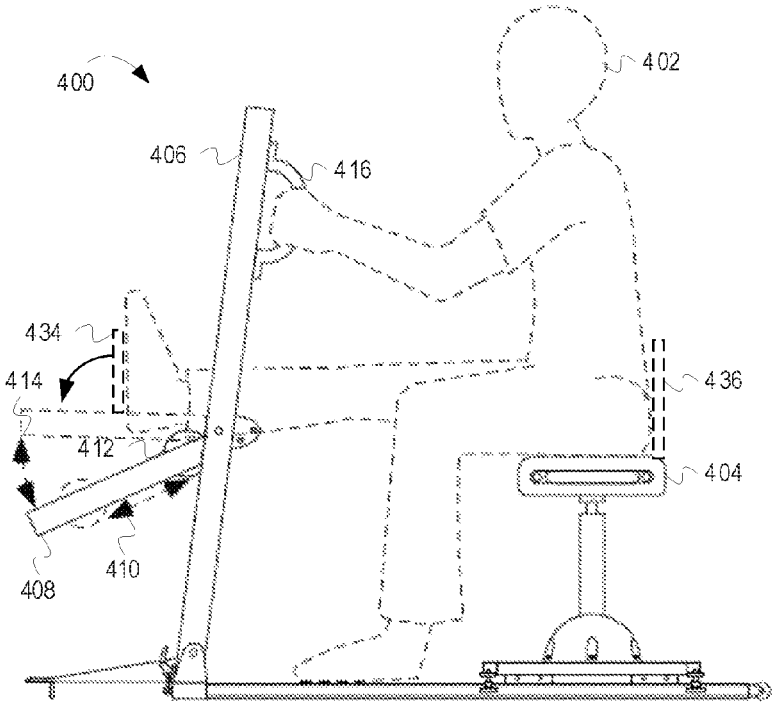
FIGS. 4A and 4B depict a person performing two separate stretching exercises using an example machine 400, according to some embodiments of the inventive subject matter.
Figure 4B:
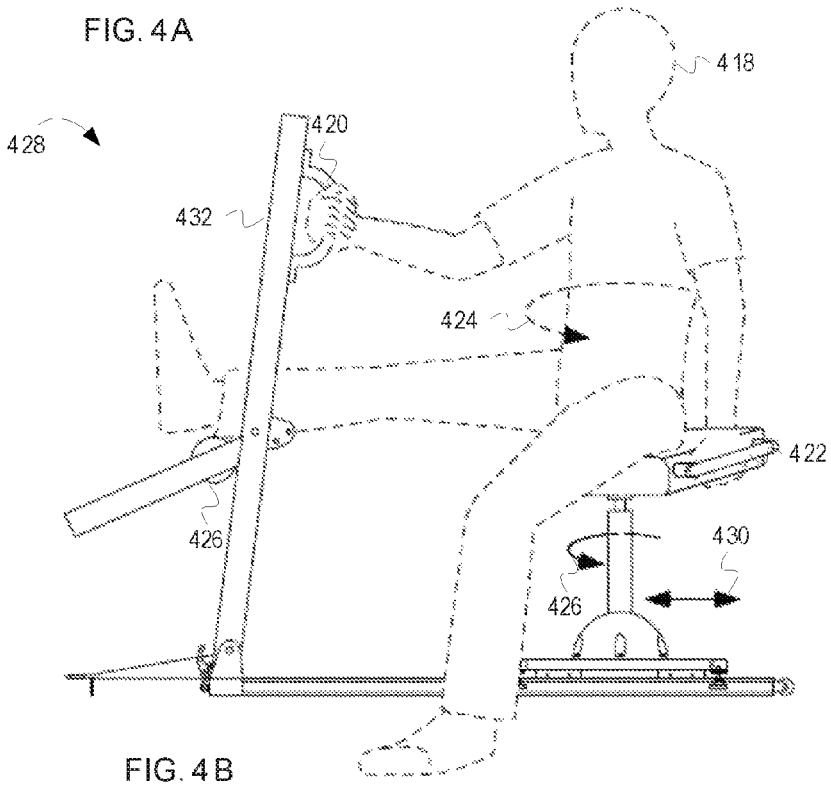

The upright portion 114 includes a leg bar assembly 106 and a leg bar 104 (depicted with an optional support pad). The leg bar assembly 106 pivots between an upright position (depicted) in which the leg bar assembly 106 is housed within the upright portion 114 and an extend position (e.g., as depicted in FIGS. 4A and 4B). In some embodiments, the leg bar assembly 106 and/or the leg bar 104 are adjustable. The upright portion 114 and/or leg bar assembly 106 can include a mechanism 110 which permits adjustment of the leg bar assembly 106 while in the upright position and/or the extended position. The mechanism 110 can include one or more positioning holes that allow for adjustability of the leg bar assembly 106 with respect to the upright portion 114 (depicted in FIGS. 4A and 4B). Similarly, in some embodiments the position of the leg bar 104 can be adjusted (i.e., relative to the leg bar assembly 106). Additionally, in some embodiments, the leg bar assembly 106 may be held in the upright position by a locking mechanism (e.g., a pin, magnet, clasps, etc.).

In some embodiments, the position of the seat 108 is adjustable horizontally and vertically relative to the machine 100. For example, the seat post 116 can include a pneumatic or hydraulic mechanism that can be used to adjust the height of the seat 108. Additionally, the seat 108 may be able to pivot about the seat post 116 making the angle of the seat with respect to the base 120 adjustable (e.g., as depicted in FIG. 4B). In one form, the distance between the seat 108 and the upright member 114 can be adjusted. For example, the seat base 118 and/or base 120 can include a mechanism (e.g., wheels, casters, glides, pads, etc.) which allows the seat base 118 to move with respect to the base 120. In the embodiment depicted in FIG. 1, the seat base 118 includes wheels 122 that roll along the base 120. Additionally, the seat base 118 includes glides that ride in channels on the base 120, preventing lateral movement of the seat 108 with respect to the machine 100.

The ramp 124 extends from the machine 100. The ramp 124 can be connected to the machine 100 in any suitable manner. For example, as depicted in FIG. 1, the ramp 124 is attached to the upright member 114. In some embodiments, the ramp 124 can be attached to the machine 100 by a mechanism that allows the ramp 124 to move with respect to the upright member 114. For example, the ramp 124 can be connected via a rotatable mechanism that allows the angle of the ramp 124 to be adjusted and/or the ramp 124 to be folded into the upright member 114. In such embodiments, the ramp 124 can include protrusions 128 that rest, and in some embodiments securely hold, the ramp 124 on the upright member 114 when the ramp 124 is folded.

FIG. 2 is a side view of an example machine 200 that can aid in proper stretching techniques, according to some embodiments of the inventive subject matter. As with the example machine depicted in FIG. 1, the example machine 200 depicted in FIG. 2 includes an upright member 216 and a seat 208 which are attached to a base 210. The machine 200 includes a foot bar member (including a foot bar 218) that is depicted as folded within the upright member 216 in FIG. 2. The seat 208 is attached to the seat base 204 via a seat post 206. Additionally, the machine 200 features a ramp 222 that is attached to the upright member 216 and/or the base 210. In some embodiments, as depicted in FIG. 2, the machine 200 includes a locking mechanism 220 that secures the upright member 216 in an upright position (as opposed to a collapsed position, discussed in more detail with regard to FIGS. 7 and 8). The locking mechanism 220 can be any suitable locking mechanism such as a claim, a bolt, a clip, etc. Additionally, the seat 208, seat post 206, seat base 204, and/or base 210 can include one or more locking mechanisms that secure the seat 208 (i.e., rotation, height, and/or position) with respect to the machine 200. Additionally, the seat post 206 can be affixed to the base 204 by a mechanism that allows for the seat post 206 to be folded so that the seat post 206 is parallel to the seat base.

While FIGS. 1-2 and the related text describe a general overview of an example machine according to some embodiments of the inventive subject matter, FIGS. 3-6 and the related text describe some example stretching exercises that can be performed using the example machine.

Example Stretches

Figure 3:
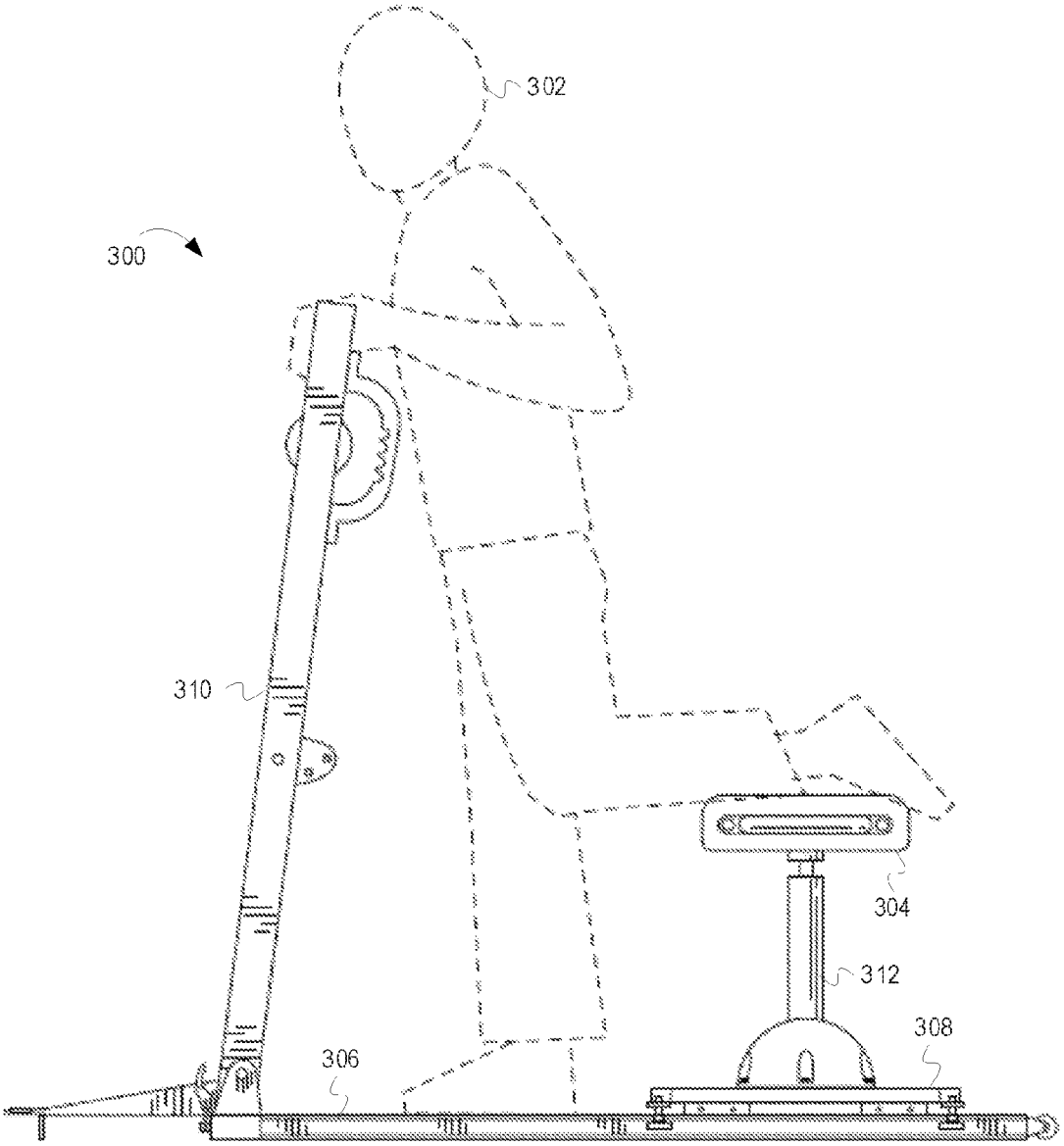
FIG. 3 depicts a person 302 performing a first stretching exercise using an example machine 300, according to some embodiment of the inventive subject matter.

FIG. 3 depicts a person 302 performing a first stretching exercise using a machine 300, according to some embodiment of the inventive subject matter. The first stretching exercise focuses on the quadriceps, tensor fasciae latae, and iliopsoas muscle groups. To begin, the person 302 slides the seat 304 (and seat base 308) into an appropriate position for his/her height. For example, a shorter person 302 can slide the seat 304 toward the upright member 310. The person may also adjust the height of the seat 304 by the pneumatic adjustment via the seat post 312. The person 302 performs the first stretching exercise by standing on the base 306 of the machine 300 facing the upright member 310 of the machine 300. While preferably holding onto the upright member 310 to maintain his/her balance, the person 302 places his/her lower leg on the seat 304, as depicted in FIG. 3. After the person 302 places his/her leg on the seat 304, the person 302 can again move the seat 304 to the optimal position for the stretch. In one embodiment, the person 302 is able to slide the seat 304 rearward during the stretch so that his/her hip extends behind his/her body allowing the person 302 to maintain a neutral pelvis throughout the stretch. Additionally, in some embodiments, the machine 300 provides resistance to movement of the seat 304 by the person 302 to enhance the stretch. One advantage of the first stretching exercise is that it allows the person 302 to perform a stretch for the quadriceps, tensor fasciae latae, and iliopsoas muscle groups while standing.

While FIG. 3 depicts a person performing a first stretching exercise, FIGS. 4A and 4B depict a person performing two separate stretching exercises using a machine 400, according to some embodiment of the inventive subject matter.

FIG. 4A depicts a person 402 in a first position of yet another stretching exercise using an example machine 400, according to some embodiment of the inventive subject matter. This stretching exercise focuses on the hamstring and adductor muscle groups. In the first position, the person 402 sits on the seat 404 and places one leg through the upright member 406 and rests his/her leg on the leg bar 412. In the example depicted in FIG. 4A, the person 402 is placing his/her right leg on the leg bar 412. Additionally, the person 402 can use the handles 416 on the upright member 406 to maintain his/her balance, maintain a neutral lumbar curve, and initiate the stretch, as depicted in FIG. 4A. In some embodiments, the example machine 400 can include a footplate 434 that is attached within the leg bar member 408. The optional footplate 434 can increase stability for the person 402 and enhance the stretch. Additionally, the option footplate 434 can collapse into the leg bar member 408 as desired. The leg bar member 408 houses the leg bar 412 and is adjustable between one or more positions, as indicated by the arrow 414 to accommodate varying levels of person 402 flexibility. Such adjustment allows the person 402 to place his/her leg at the optimal height for the stretch. Additionally, the leg bar 412 is adjustable between one or more positions, as indicated by the arrow 410 to accommodate person height. This allows persons of varying heights to utilize the same machine while allowing for various flexibilities to be addressed within the same machine. Additionally, the example machine 400 depicted in FIG. 4A includes an optional backrest 436. The first position of the stretch depicted in FIG. 4A initiates a stretch of the hamstring muscle group. From this position depicted in FIG. 4A, the person 402 may rotate the seat 404 to the right. Such rotation allows the right hip to adduct in relationship to the pelvis, which places a stretch along the hamstring that elongates the sciatic nerve.

FIG. 4B depicts a person 418 an additional position of the stretching exercise described above using an example machine 428, according to some embodiments of the inventive subject matter. The person 418 rotates his/her body to the second position from the first position. In the example depicted in FIG. 4B, the person 418 rotates his/her body to the left, as indicated by arrow 424. As the person 418 rotates his/her body to the left, the seat likewise rotates to the left, as indicated by arrow 426. As shown in this example, while rotating his/her body, the person 418 places his/her right hand on the handle 420 on the upright member 432 and his/her left hand on the handle 422 attached to the seat. In some embodiments, the handles can be marked (e.g., color-coded, numbered, etc.) and the person 418 can be instructed of the proper technique by being told which handle to hold with which hand based on the markings. As the person 418 rotates on the seat, the seat slides backward, as indicated by arrow 430, to accommodate for the insertion points of the adductor muscles at the medial aspect of the leg in the second position when compared to the first position. This is important because with a typical hamstring stretch, the first resistance that is reached is the part of the muscle that is then stretched. With this capacity to rotate, stretching can be achieved within multiple planes of the muscle attachment, therefore stretching different aspects of the muscle. The movement of the seat provides a dual plane of motion (i.e., a sagittal plane and transverse plane) which enhances the benefits of the stretch, for example, by stretching the sciatic nerve. The second position of the second stretch, depicted in FIG. 4B, initiates a stretch of the adductor muscle group.

Figures 5, 6A, 6B:
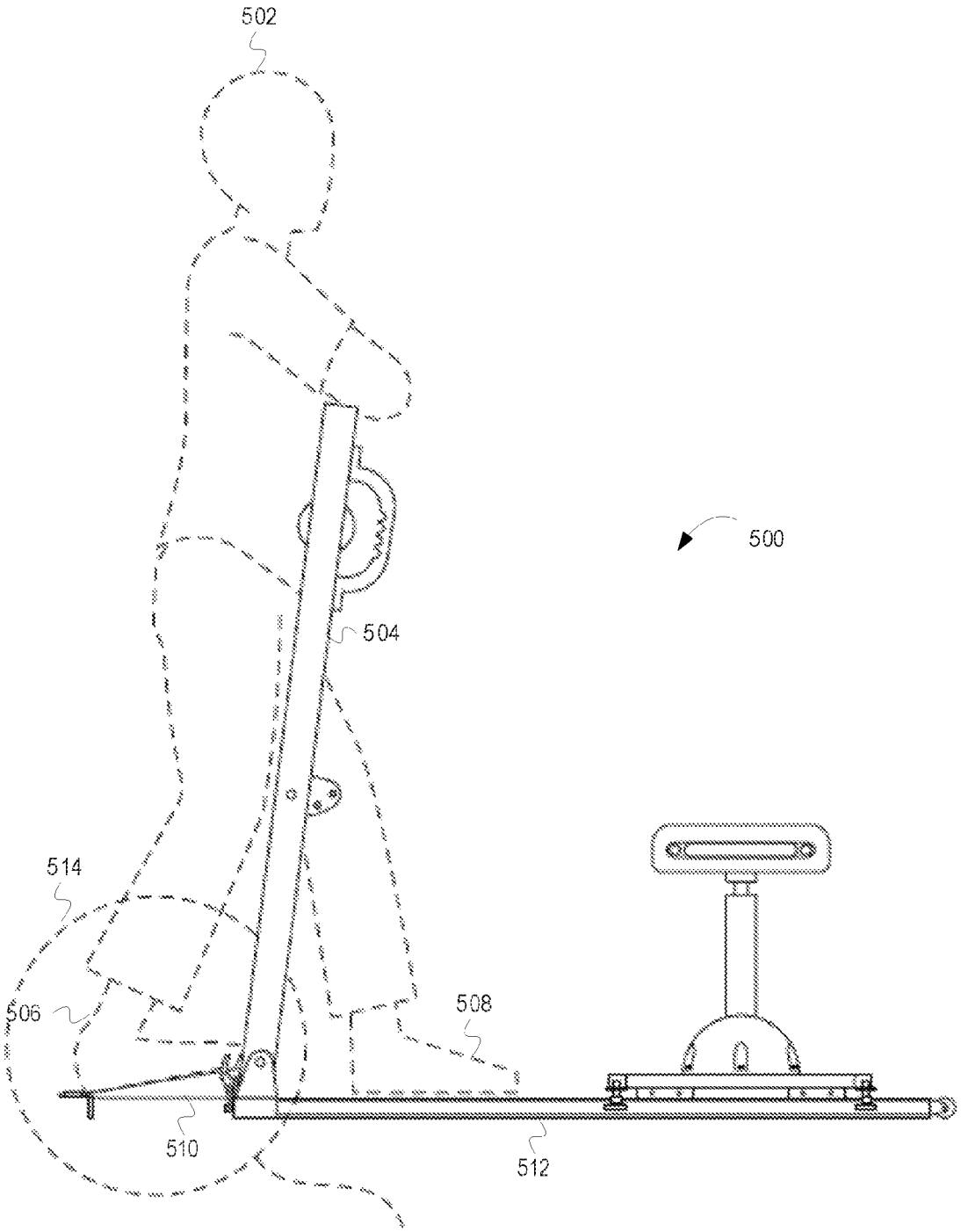
FIG. 5 depicts a person 502 performing a third stretching exercise using an example machine 500, according to some embodiments of the inventive subject matter.
FIGS. 6A and 6B depict an exploded view of a portion of the example machine depicted in FIG. 5.
Figure 6A:
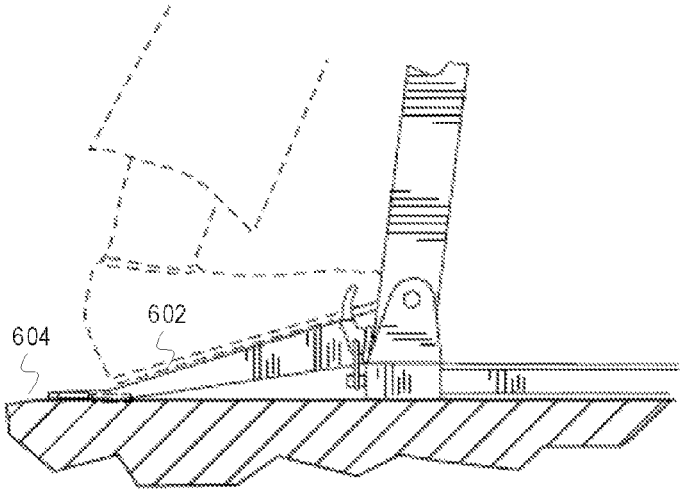
Figure 6B:
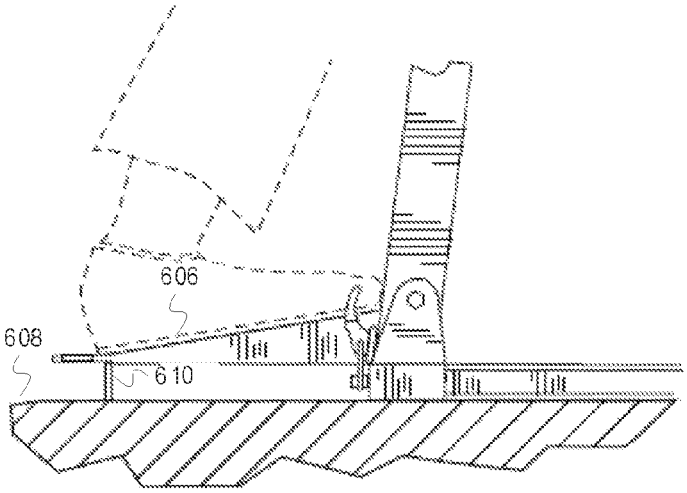

While FIGS. 4A and 4B depict a person performing two separate stretching exercises, FIG. 5 depicts a person 502 performing yet another stretching exercise using an example machine 500, according to some embodiments of the inventive subject matter. This stretching exercise focuses on the gastrocnemius and soleus muscles. To begin, the person 502 steps on the ramp 510 with a first foot (in FIG. 5, his/her right foot 506) and steps through the upright member 504 with his/her second foot (in FIG. 5, his/her left foot 508). For example, the person 502 steps through the upright member 504 with his/her left foot 508 and onto the base 512 of the machine 500 with his/her left foot keeping the right foot on the ramp 510. While in this position, the person 502 can stretch either his/her soleus muscle and Achilles tendon or his/her gastrocnemius muscle. By bending his/her right knee (as depicted in FIG. 5), the person 502 can stretch the soleus muscle and Achilles tendon. By straightening his/her right knee, the person 502 can stretch the gastrocnemius muscle. Optionally, the person 502 can hold onto the upright member 504 to help maintain his/her balance. One advantage of the example machine 500 is that it allows a person to stretch the gastrocnemius and soleus muscles in a position that mimics a natural movement (i.e., that mimics the person's 502 natural gait). For example, when a person walks, his/her hip extends. In performing the third stretching exercise with the example machine 500, the person 502 maintains hip extension while stretching his/her gastrocnemius and soleus muscles.

While FIG. 5 depicts a person performing a stretching exercise using machine 500, FIGS. 6A and 6B depict an exploded view of the ramp, as indicated by the dashed circle 514 in FIG. 5.

FIG. 6A depicts a ramp portion 602 of an example machine in a first position, according to some embodiments of the inventive subject matter. In some embodiments, the ramp 602 is adjustable with respect to the ground 604. This adjustment allows the incline of the ramp 602 to be adjusted based on a person's flexibility. In the first position, the ramp 602 is at its steepest incline.

FIG. 6B depicts the ramp portion 606 of an example machine in a second position, according to some embodiments of the inventive subject matter. As depicted in FIG. 6B, the ramp 606 in the second position allows for an incline with respect to the ground 608 that is smaller than that provided by the ramp in the first position depicted in FIG. 6A. This adjustment can be provided through any suitable means. For example, this adjustment can be achieved by placing dedicated spacers below the ramp 606, placing objects that a person may find around his/her home under the ramp 606, or by a built-in mechanism. In the example depicted in FIG. 6B, this adjustment is achieved through a built-in member 610 that is rotatably attached to the underside of the ramp 606. Additionally, although FIGS. 6A and 6B depict an embodiment of a machine that includes only two levels of incline, embodiments of the inventive subject matter are not so limited. For example, in some embodiments, a person or medical professional can adjust the incline of the ramp through any suitable number of levels.

Collapsibility

Figure 7:
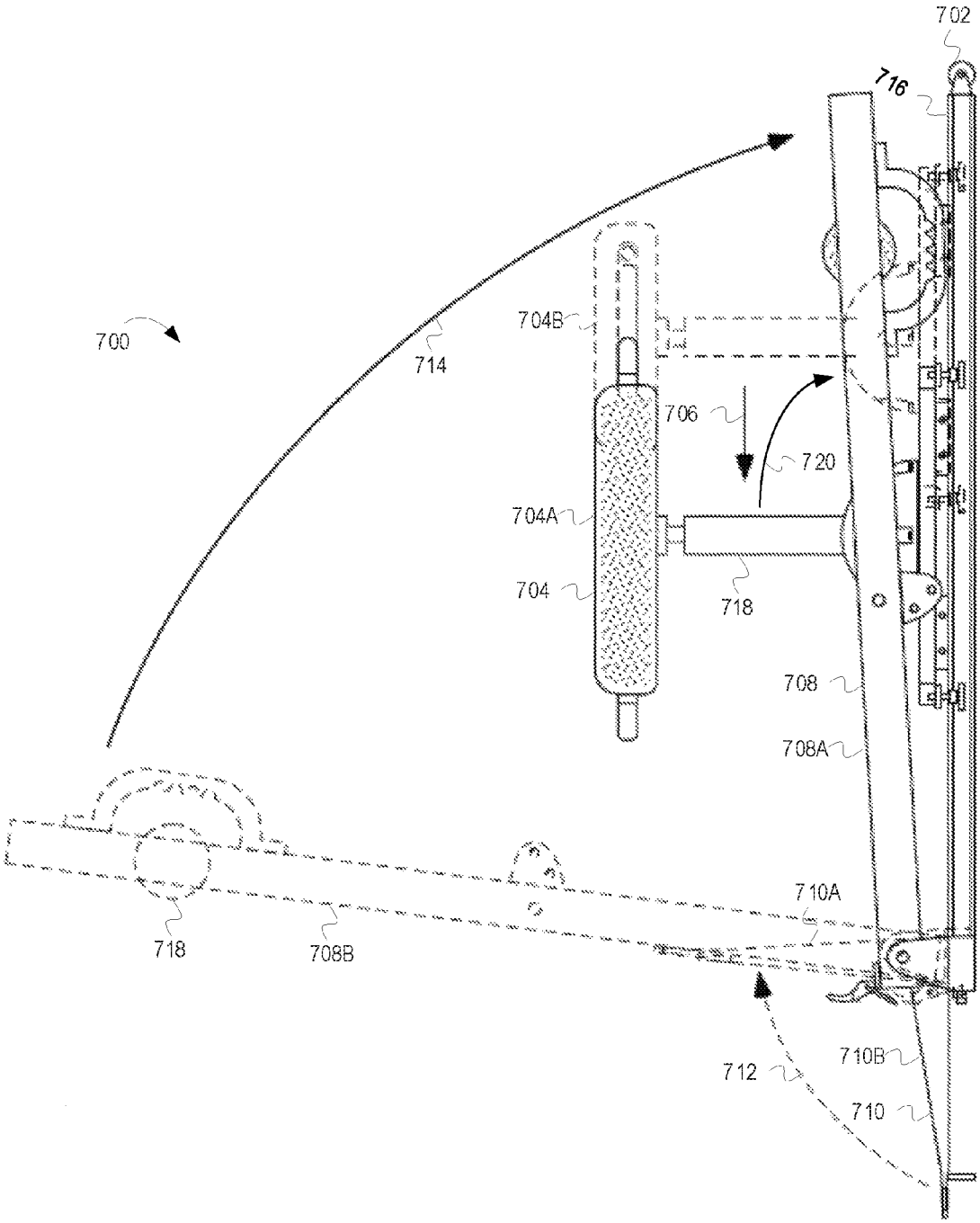
FIG. 7 is a side view of an example machine 700 depicting collapsibility of the example machine 700, according to some embodiments of the inventive subject matter.
Figure 8:
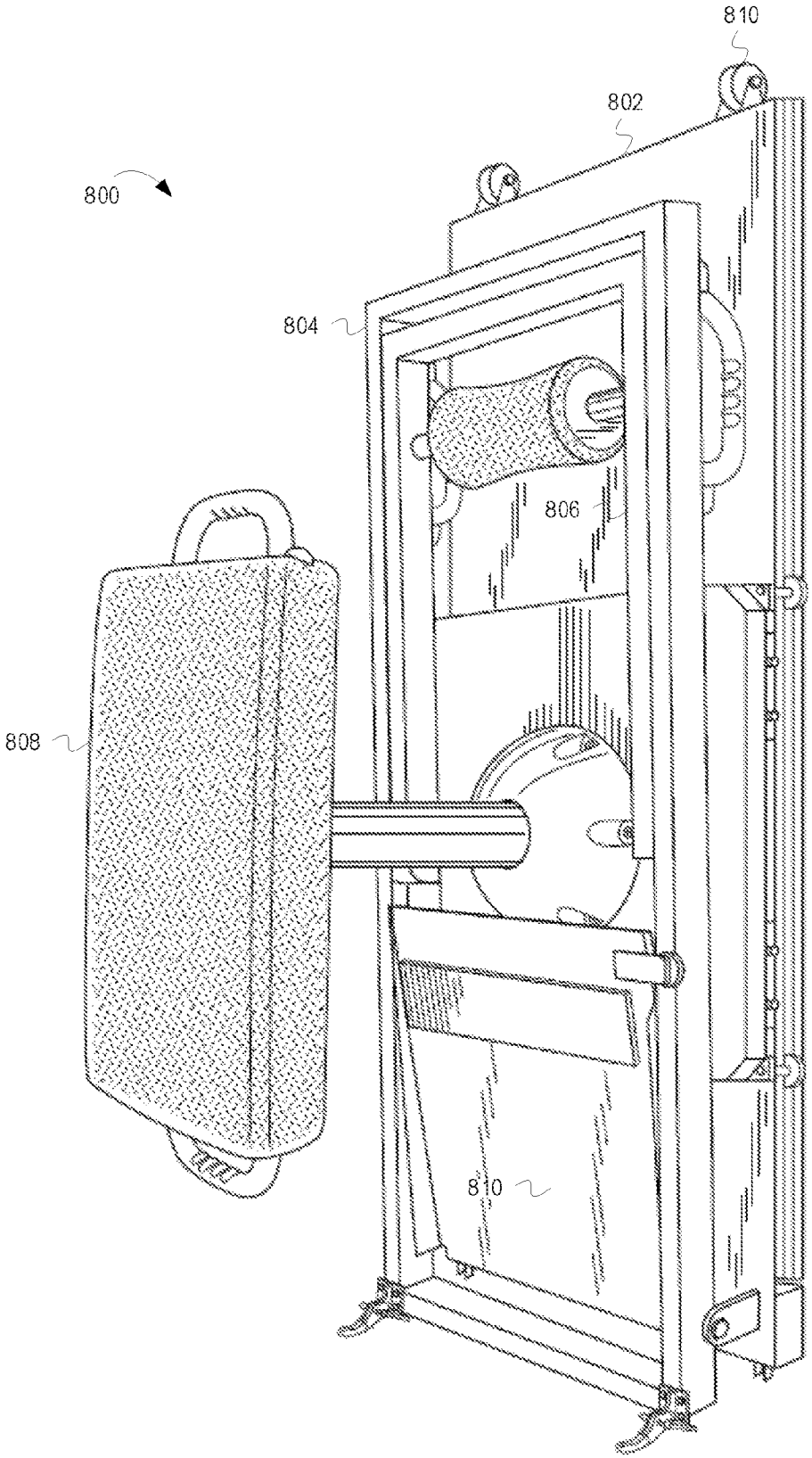
FIG. 8 is a perspective view of an example machine 800 in a collapsed state, according to some embodiments of the inventive subject matter.

While FIGS. 3-6 and the related text describe some example stretching exercises that can be performed using the example machine, FIGS. 7 and 8 and the related text describe a manner in which some embodiments of the machine can be collapsed to facilitate easy transport and storage.

FIG. 7 is a side view of an example machine 700 depicting collapsibility of the machine 700, according to some embodiments of the inventive subject matter. In some embodiments, the machine 700 is collapsible to facilitate easy transport and storage. For example, portions of the machine can move and/or collapse onto the base 716. In the example depicted in FIG. 7, the upright member 708 moves from a first position 708B to a second position 708A (as indicated by arrow 714) and the ramp 710 moves from a first position 710B to a second position 710A (as indicated by arrow 712). In some embodiments, the seat 704 slides from a first position 704B to a second position 704A, allowing the upright member 708 to be placed in the second position 708B and the ramp 710 to be placed in the second position 710B. Additionally, in some forms, the seat 704 may also rotate to allow the machine 700 to be placed in a collapsed position. In other embodiments, the seat can also be placed in a second position such that the seat post 718 is parallel with the base 716 (as indicated by arrow 720). Allowing the seat post to collapse to a position that is parallel with the base 716 will allow the machine 700 to fit in an storage area such as under a bed or standing in a closet. In embodiments which include an optional backrest (e.g., as shown in FIG. 4A), the optional backrest can also collapse. To facilitate easy transport, some embodiments of the inventive subject matter include a mechanism which allows the machine 700 to be easily moved. Although not depicted, in some embodiments the seat 704 can be lowered, removed, or otherwise adjusted for storage. In the example shown in FIG. 7, the machine 700 include wheels 702 which allow the machine 700 to be moved easily once in the collapsed position.

FIG. 8 is a perspective view of a machine 800 in a collapsed state, according to some embodiments of the inventive subject matter. As depicted in FIG. 8, the ramp 810 is folded into the upright member 804 and the upright member 804 is collapsed onto, or near, the base 802. Additionally, the seat 808 is positioned through the upright member 808. In some embodiments, the machine 800 can be lifted while in its collapsed state and rolled via the wheels 810.

General

While FIGS. 3-6 depict three stretching exercises that can be performed using the example machine, the number and types of stretching exercises that can be performed using embodiments of the inventive subject matter are not so limited. For example, a nerve glide assist could be added to the foot plate to assist with a sciatic nerve glide. This plate could be attached to a control lever on the upright bar that would allow the user to manipulate the foot into a dorsiflexion position, thus gliding the sciatic nerve. In another embodiment, the seat could include a seatback and arms. This seatback can help persons maintain a neutral lumbar posture during hamstring stretching. Pressure could then be applied to the arms of the seatback to flex the person at the hips, applying a neutral pelvis and improving the hamstring stretch. The person can also stretch the piriformis muscle by placing his/her leg on the seat and gliding the seat forward. Additionally, while FIGS. 3-6 depict an example machine upon which three stretching exercises can be performed, it is not necessary that the machine be able to accommodate all three stretching exercises. For example, embodiments of the inventive subject matter may be designed for a single stretching exercise, two stretching exercises, three stretching exercises, or any number of stretching exercises. It should also be noted that the locations of one or more components of the example machine described herein can be altered without departing from the scope of this application. For example, in some embodiments, the ramp can be located on a side of the machine adjacent to the upright member or opposite the upright member. As another example, although a base is depicted upon which a person can stand, in some embodiments a hollow frame may be substituted for the base. It is also not necessary that the machine include all of the adjustability features described herein. For example, it is not necessary that the seat, upright member, ramp, foot bar, etc. be adjustable, or that the machine be collapsible.

What is claimed is:

1. An apparatus comprising:

a base;

a seat connected to said base, wherein the seat can rotate with respect to the base in a plane substantially parallel to that of the base;

an upright member connected to said base, wherein said upright member includes a leg bar assembly configured to allow a stretching exercise to be performed using said leg bar assembly; and a ramp, wherein said ramp is movably attached to one or more of said upright member and said base, wherein said ramp is movable from a first position to a second position, and wherein when in said first position said ramp is extended away from said base and when in said second position said ramp is collapsed into said upright member.

2. The apparatus of claim 1, further comprising:

a leg bar attached to said leg bar assembly, said leg bar positioned for a person to place one or more legs on said leg bar while seated on the seat to perform the stretching exercise.

3. The apparatus of claim 2, wherein said leg bar is adjustable within said leg bar assembly.

4. The apparatus of claim 1, wherein said seat is one or more of slidable and height adjustable with respect to said base.

5. The apparatus of claim 1, wherein said leg bar assembly is movable from a first position to a second position, wherein when in said first position said leg bar assembly is disposed within said upright member and when in said second position said leg bar assembly is extended from said upright member.

6. The apparatus of claim 1, wherein said ramp is configured to allow a second stretching exercise to be performed.

7. The apparatus of claim 1, wherein said ramp includes an adjustment mechanism, wherein said adjustment mechanism adjusts an incline of said ramp with respect to said base.

8. The apparatus of claim 1, wherein said upright member is movably connected to said base, and wherein said upright member can be moved from a first position to a second position, wherein when in said first position said upright member is extended away from said base and when in said second position said upright member is collapsed onto said base.

9. The apparatus of claim 8, further comprising:

an upright member locking mechanism, wherein said upright member locking mechanism secures said upright member in said first position.

10. The apparatus of claim 1, wherein said seat is movably connected to said base, and wherein said seat can be moved from a first position to a second position, wherein when in said first position said seat is extended above the base and when in said second position said seat is collapsed onto said base.

11. An apparatus for aiding in proper stretching technique, the apparatus comprising:

a base;

a seat base, wherein said seat base is movably secured to said base;

a seat post, wherein said seat post is attached to said seat base;

a seat, wherein said seat is attached to said seat base via said seat post, and wherein said seat is rotatable on said seat post;

an upright member, wherein said upright member is attached to said base;

a leg bar assembly, wherein said leg bar assembly is attached to said upright member, and wherein said leg bar assembly is collapsible within said upright member; and a ramp, wherein said ramp is independently movable of said seat and said upright member, wherein said ramp is movably attached to one or more of said upright member and said base, wherein said ramp is movable from a first position to a second position, and wherein when in said first position said ramp is extended away from said base and when in said second position said ramp is collapsed into said upright member.

12. The apparatus of claim 11, wherein said seat base is movable in a direction substantially parallel to said base.

13. The apparatus of claim 11, further comprising:

a leg bar attached to said leg bar assembly, said leg bar positioned for a person to place at least one leg on said leg bar while seated on said seat to perform a first stretching exercise, wherein said first stretching exercise is independent of said ramp.

14. The apparatus of claim 11, further comprising:

an upright locking mechanism, wherein said upright member is movably connected to said base, and wherein said upright member can be moved from a first position to a second position, wherein when in said first position said upright member is extended away from said base and when in said second position said upright member is collapsed onto said base;

wherein when the apparatus is in use, the upright member is in said first position.

15. The apparatus of claim 11, wherein when in use, the upright member and ramp are stationary relative to the base.

16. The apparatus of claim 11, wherein said seat is rotatable on said seat post in a plain substantially parallel to said base.

17. An apparatus for aiding in proper stretching technique, the apparatus comprising:

a base;

a seat base, wherein said seat base is movably secured to said base;

a seat post, wherein said seat post is attached to said seat base;

a seat, wherein said seat is attached to said seat base via said seat post, and wherein said seat is rotatable on said seat post;

an upright member, wherein said upright member is attached to said base;

a leg bar assembly, wherein said leg bar assembly is attached to said upright member, and wherein said leg bar assembly is collapsible within said upright member; and a ramp, wherein said ramp is independently movable of said seat and said upright member, wherein said ramp is movably attached to one or more of said upright member and said base, wherein said ramp is movable from a first position to a second position, and wherein when in said first position said ramp is extended away from said base and when in said second position said ramp is collapsed into said upright member;

wherein said apparatus is configured to allow a user to perform at least a first stretching exercise, a second stretching exercise, and a third exercise, wherein, wherein during said first stretching exercise, the apparatus is configured to support a first leg of the user with said seat, support a second leg of said user with said base, and allow said user to grasp said upright member, wherein during said second stretching exercise, the apparatus is configured to allow said user to sit on said seat and support said first leg with said leg bar assembly, and wherein during said third stretching exercise, the apparatus is configured to support a first foot of said user with said ramp, allow the user to step through said upright member and place a second foot of said user on said base, and allow said user to grasp said upright member.

18. The apparatus of claim 17, wherein when in use, the upright member and said ramp are stationary relative to the base.

* * * * *